United States Patent [19]

Tokizaki et al.

[11] Patent Number: 4,967,834

[45] Date of Patent: Nov. 6, 1990

[54] HEAT EXCHANGERS

[75] Inventors: Kazumi Tokizaki; Ryoichi Hoshino; Hironaka Sasaki, all of Oyamashi, Japan

[73] Assignee: Showa Aluminum Kabushiki Kaisha, Osaka, Japan

[21] Appl. No.: 358,711

[22] Filed: May 30, 1989

[51] Int. Cl.[5] ..... F28D 1/03; F28F 9/02

[52] U.S. Cl. ..... 165/153; 165/175; 165/176

[58] Field of Search ..... 165/153, 175, 176

[56] References Cited

U.S. PATENT DOCUMENTS 4,625,794 12/1986 Dürst ..... 165/170

FOREIGN PATENT DOCUMENTS 61-161398 7/1986 Japan ..... 165/153

61-252495 11/1986 Japan ..... 165/153

62-280584 12/1987 Japan ..... 165/153

62-288497 12/1987 Japan ..... 165/153

850871 10/1960 United Kingdom ..... 165/153

*Primary Examiner*—Martin P. Schwadron

*Assistant Examiner*—Allen J. Flanigan

[57] ABSTRACT

A heat exchanger having a core and headers, the core including a plurality of tubular elements having tanks at respective ends and corrugated fins sandwiched between one tubular element and the next, and the headers being provided at corners of the core to introduce a cooling medium and discharge it out of the core, wherein each header comprises a flat body portion and a cylindrical head portion produced eccentric of the body portion so that each header is disposed at the corner of the core without allowing any portion thereof to protrude beyond the outside line of the heat exchanger.

4 Claims, 4 Drawing Sheets

HEAT EXCHANGERS

BACKGROUND OF THE INVENTION

The present invention relates to a heat exchanger for use as an evaporator in car cooling system, a radiator for industrial uses, and an oil cooler. More particularly, the present invention relates to a heat exchanger for such use, having a core and headers, the core including a plurality of tubular elements and corrugated fins sandwiched therebetween, and the headers allowing a cooling medium to be introduced into the core and discharged therefrom.

To explain a known heat exchanger of this type in detail, reference will be made to FIGS. 9 and 10:

The known heat exchanger is constituted by a core 114 and headers 100 mounted at respective corners in the manner shown in FIG. 10. An example of the headers is shown FIG. 9. The core 114 includes tubular elements 110 provided with tanks 111 at one end, and corrugated fins between one tubular element and the next. One of the headers introduces a cooling medium into the core 114 and the other header discharges it therefrom after circulating through the core 114.

Referring to FIG. 9, the header 100 is made of a pipe of a rectangular cross-section, having a flat body portion 102 and a cylindrical head portion 101. The reference numeral 103 denotes an aperture through which the header 100 is connected to a tank 111. An inlet pipe (not shown) and an outlet pipe (not shown) are connected to the cylindrical head portion 101. In FIG. 10 the reference numeral 112 denotes side plate attached to the outermost fin 113 to reinforce the core 114 of the heat exchanger.

One disadvantage of this known heat exchanger resides in the construction of the header described above. As is evident in FIG. 10, the cylindrical head portion of 101 projects beyond the side of the body portion 102 by a distance (i), thereby producing a dead space alongside the side plates 112. As a result a larger casing (not shown) is required to accommodate the core of the heat exchanger. For installation a large space is required. The large casing increases the production cost and the larger installation space limits the application of the heat exchanger.

One solution is disclosed in Japanese Utility Model Publication (unexamined) 61-169364, which teaches that headers are disposed within the core of a heat exchanger. However, this proposal makes assembling work complicated, which reflects in production cost.

Accordingly, an object of the present invention is to provide a heat exchanger having such headers as to allow the core of a heat exchanger to be compactly housed in a relatively small casing.

Another object of the present invention is to provide a heat exchanger capable of easy assembly.

Other objects and advantages of the present invention will become more apparent from the following detailed description, when taken in conjunction with the accompanying drawings which show, for the purpose of illustration only, one embodiment in accordance with the present invention.

SUMMARY OF THE INVENTION

These objects of the present invention is achieved by providing a heat exchanger having a core and headers, the core including a plurality of tubular elements having tanks at respective ends and corrugated fins sandwiched between one tubular element and the next, and the headers being provided at corners of the core to introduce a cooling medium and discharge it out of the core, wherein each header comprises a flat body portion and a cylindrical head portion produced offset relative to the body portion so that each header is mounted at the corner of the core without allowing any portion thereof to protrude beyond the outside line of the heat exchanger.

DETAILED DESCRIPTION OF THE PREFERRED EMBODIMENTS

The present invention can be applied to many uses. The illustrated embodiment is an example for use an evaporator in the automobile air conditioning system.

Figure 6:
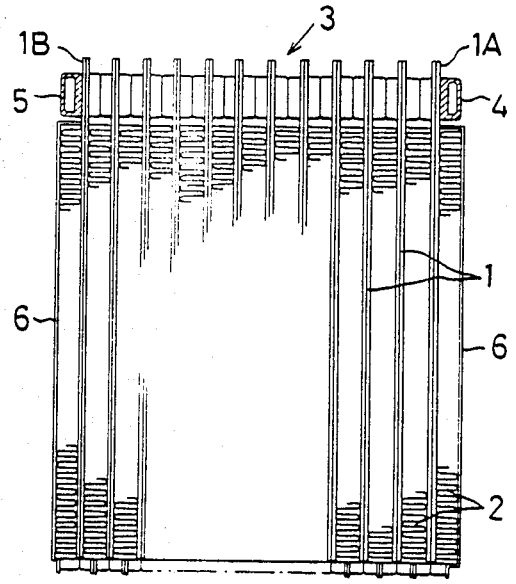
FIG. 6 is a partly cross-sectional view showing an overall look of the heat exchanger.

As shown in FIG. 6, the heat exchanger has a core 3 having a plurality of tubular elements 1 and corrugated fins 2 sandwiched therebetween, the core 3 being reinforced at each side by side plates 6. The side plates 6 define the outside lines of the heat exchanger. An inlet header 4 is mounted at a right-hand corner of the core 3 by being attached to the right-hand outermost tubular element 1A. Likewise, an outlet header 5 is mounted at a left-hand corner of the core 3 by being attached to the left-hand outermost tubular element 1B. The tubular elements 1, the corrugated fins 2 and the headers 4, 5 and the side plates 6 are brazed to each other in a brazing furnace.

Figure 7:
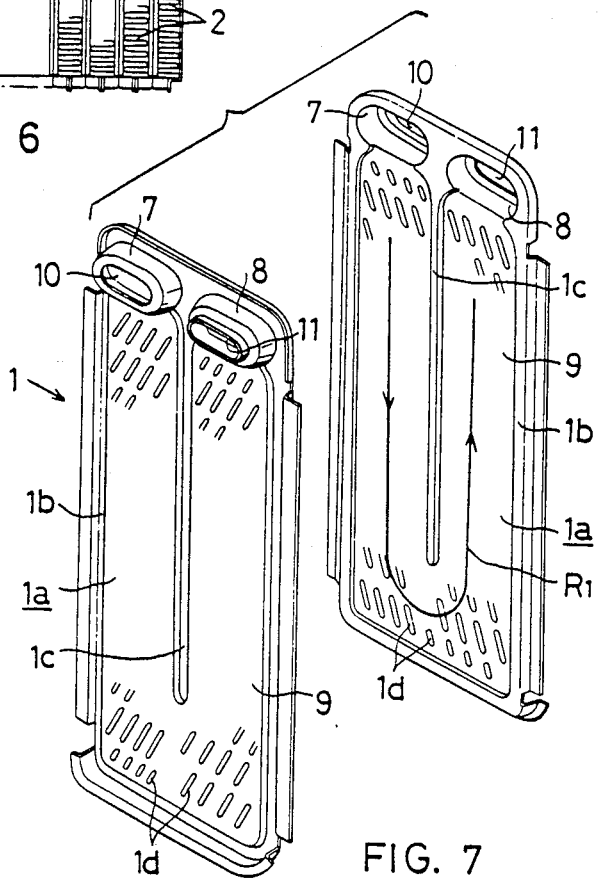
FIG. 7 is a perspective view showing halved plate members constituting a tubular element.
Figure 8:
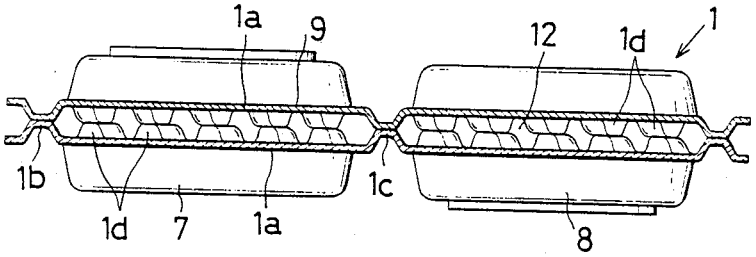
FIG. 8 is a cross-sectional view showing the tubular elements.
Figure 9:
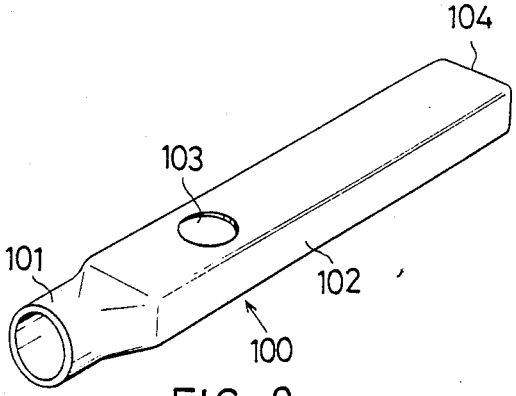
FIG. 9 is a perspective view showing an example of the known headers.
Figure 10:
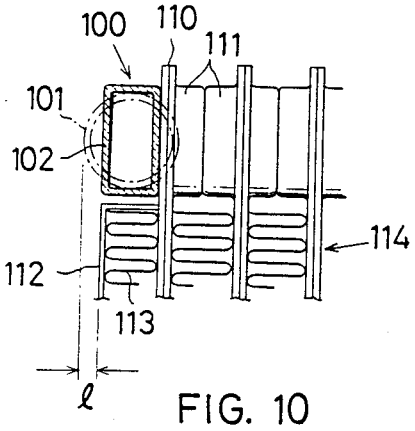
FIG. 10 is a partly broken side view showing the joint between the header and the core of the heat exchanger.

FIG. 7 shows halved tray-like tubular members **1*a* one of which is provided with an inlet tank 7 having an inlet port 10 and an outlet tank 8 having an outlet port 11. The halved tubular members la are brazed to each other at their rims 1*b*, thereby forming a tubular element with a cooling medium path 9. The arrow R1 shows a cooling medium stream flowing through the path 9. The cooling medium is introduced into the path 9 through the inlet port 10, and is discharged through the outlet port 11**.

The halved tubular members **1*a* are made by pressing a brazeable sheet which has a core sheet clad in a brazing substance. The cooling medium path 9 is formed in U-form by a partition 1*c*, and there are provided a number of projections 1*d*** designed to disturb the flow of the cooling medium so as to enhance the efficiency of heat transmission.

Each of the corrugated fins 2 is as wide as the tubular elements 1, and brazed to the adjacent tubular elements 1. The corrugated fins are preferably provided with louvers on their surfaces.

Referring to FIGS. 1 to 4, the manner of fixing the outlet header 5 at the left-hand corner of the core 3. The header 5 has a body portion 5*a* having an aperture 5*d* and a head portion 5*b* eccentric of the body portion 5*a*. The body portion 5*a* has a rectangular cross-section and the head portion 5*b* has a circular cross-section. The header 5 is placed in a space above the side plate 6 in such a manner that the circular head portion 5*b* does not project beyond the flat side 5*c* of the body portion 5*a*, which is flush with the side plate 6, wherein the aperture 5*d* accepts a flange 13 surrounding the outlet port 11. An opposite end of the head portion 5*b* is closed by a lid 5*e*.

Figure 5:
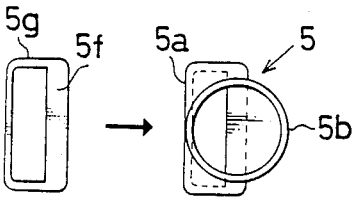
FIG. 5 is an explanatory view showing the process of fabricating the header.

Referring now to FIG. 5, the method of fabricating the headers 4 and 5 will be described:

A pipe 5*g* of a rectangular cross-section is prepared. As shown in FIG. 5 the pipe 5*g* has a thick wall portion 5*f*. The thick wall portion 5*f* is forced to expand by a press to form into the cylindrical head portion 5*b* having an even wall thickness. The head portion 5*b* is offset relative to the axis of the body portion 5*a* so that when the header 5 is mounted at the corner of the core 3, the head portion 5*b* is biased toward the core 3. In obtaining a material pipe 5*g* it is possible to mold it by extrusion or else, to produce it by electrically weld seaming method. A further alternative is to use a bottomed pipe produced by forging. The bottomed pipes by forging are advantageous in eliminating the necessity of employing the lid 5*e*, thereby simplifying the assembling process. Under the forging method it is also preferable that the headers have the thick wall portion 5*f*. Whatever the method may be, the important thing is that the material pipes 5*g* can be worked to form the header 5 having the structure described above.

The discharge pipe 14 is welded to the header 5 through a sleeve 15 in a liquidtight manner; in the illustrated embodiment, the reference numeral 16 denotes an argon welded part.

Figure 1:
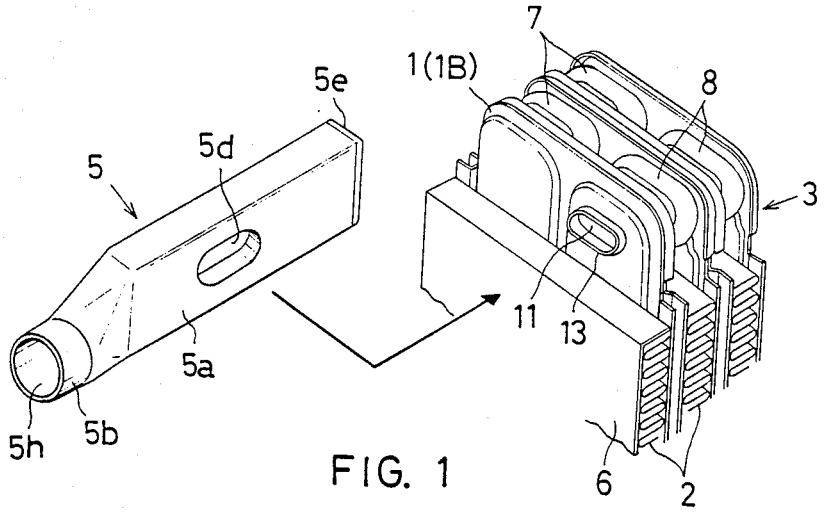
FIG. 1 is an exploded perspective view of a core of a heat exchanger and a header to be attached thereto according to the present invention.
Figure 2:
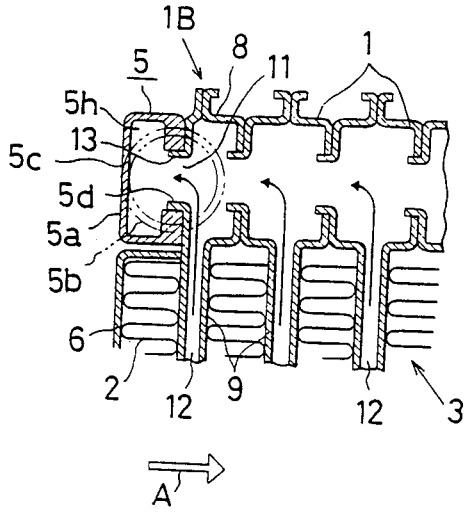
FIG. 2 is a front cross-sectional view showing the joint between the header and the core of the heat exchanger.
Figure 3:
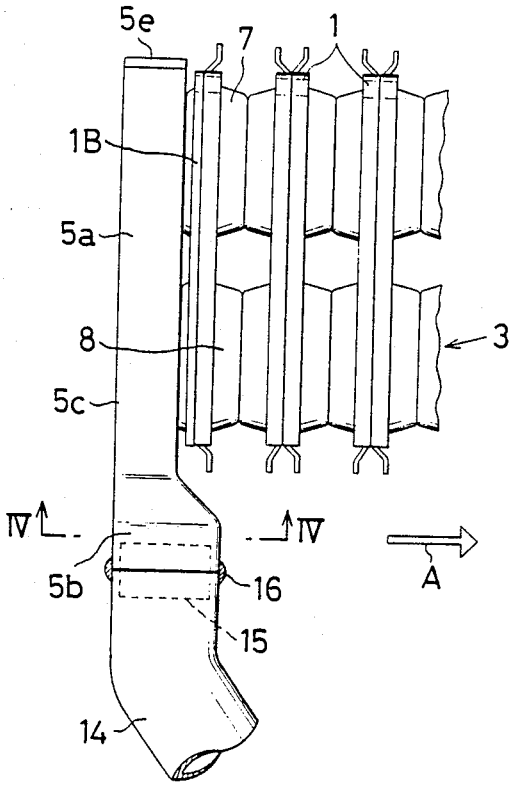
FIG. 3 is a plan view more particularly showing the header attached to the core of the heat exchanger.
Figure 4:
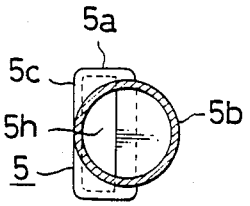
FIG. 4 is is a cross-sectional view on an enlarged scale taken along the line IV—IV in FIG. 3.

As shown in FIG. 1 the outermost tubular element 1B has a different structure from the other tubular elements, in that it is not provided with the tank 7 or 8 but only with an outlet port 11 surrounded by the flange 13. As described above, the flange 13 fits in the aperture 5*d* of the outlet header 5 to secure the the header 5 so as to effect a cooing medium communication between a path 5*h* in the header 5 and the tubular elements 1. The header 5 is brazed to the tubular element 1B in the brazing furnace, with its flat side 5*c* being flush with the side plate 6. The head portion 5*b* is made eccentric of the axis of the body portion 5*a* so as to be situated toward the tubular element 1B. As a result, the head portion 5*b* is situated within the side 5*c* of the header 5. As best shown in FIG. 1, the header 5 is mounted at the left-hand corner of the core 3. The corner is exposed outside and has no obstacle or fixing the header. The fixing work is smoothly carried out.

In the illustrated embodiment the head portion 5*b* has a circular cross section but it can be elliptical preferably having a vertically long axis.

The inlet header 4 is attached to the right-hand outermost tubular element 1A in the same manner with the outlet header 5, and the description of it will be omitted for simplicity.

The cooling medium is introduced into the inlet tank 7 of the tubular element 1A through the inlet header 4, and circulates through the paths 12 in each tubular element 1 in which the cooling medium flows in U-pattern and reaches the respective outlet tanks 8. Then the cooling medium is discharged through the outlet port 11 of the tubular element 1B. Finally it is led into the discharge pipe 14 and discharged outside. While the cooling medium flows through the tubular elements 1 it absorbs heat from the air flowing through the corrugated fins 2.

As is evident from the foregoing description, the inlet and outlet headers are mounted in the heat exchanger without no protruberance beyond the outside line of the heat exchanger, thereby minimizing the size of a casing for covering the heat exchanger. The headers are fixed at the corners of the heat exchanger, thereby providing no handicap in the fixing work.

What is claimed is:

1. A heat exchanger having a core and first and second headers, the core comprising a plurality of tubular elements including a pair of outer elements, said core having tanks at one end thereof and corrugated fins sandwiched between one tubular element and the next, and the headers being provided at corners of the core for introducing a cooling medium and discharging it out of the core, said first and second headers being disposed along side the respective outer tubular elements, said first and second headers including elongate flat body portions having central axes, each said flat body portion being defined in part by inner and outer wall portions spaced parallel to each other about said central axis, with the inner wall portions of said headers being connected to a respective tank, said headers each further comprising a cylindrical head portion located at one end of said flat body portion and connected to a fluid inlet or outlet, said cylindrical portions each being offset relative to a respective central axis such that the cylindrical head portion is disposed inward of a respective outer wall portion.

2. A heat exchanger as defined in claim 1, wherein the header is made of a pipe having a rectangular cross-section and a thick wall portion, the thick wall portion of the pipe being forced to expand into a cylindrical configuration.

3. A heat exchanger as defined in claim 1, wherein the header is made of a bottomed rectangular pipe produced by forging, the pipe being forced to expand at its open end until the end is shaped into a cylindrical configuration.

4. A heat exchanger as defined in claim 3, wherein the forged pipe has a thick wall portion, and wherein the thick wall portion is forced to expand into a cylindrical configuration.

* * * * *